US011932476B1

(12) United States Patent
DeVito

(10) Patent No.: US 11,932,476 B1
(45) Date of Patent: Mar. 19, 2024

(54) INCREMENTAL ADVANCE DISPENSER AND METHOD

(71) Applicant: Wormser Corporation, Englewood, NJ (US)

(72) Inventor: Ralph James DeVito, Oxford, CT (US)

(73) Assignee: WORMSERGROUP, Englewood, NJ (US)

( * ) Notice: Subject to any disclaimer, the term of this patent is extended or adjusted under 35 U.S.C. 154(b) by 578 days.

(21) Appl. No.: 17/178,744

(22) Filed: Feb. 18, 2021

(51) Int. Cl.

| | |
|---|---|
| ***B65D 83/00*** | (2006.01) |
| ***A45D 40/02*** | (2006.01) |
| *A45D 40/00* | (2006.01) |

(52) U.S. Cl.
CPC ..... *B65D 83/0022* (2013.01); *A45D 40/02* (2013.01); *A45D 2040/0043* (2013.01); *A45D 2040/0062* (2013.01)

(58) Field of Classification Search
CPC ..... B65B 83/002; A45D 40/02; A45D 2040/0043; A45D 2040/0062
See application file for complete search history.

(56) References Cited

U.S. PATENT DOCUMENTS

| | | | | | |
|---|---|---|---|---|---|
| 544,609 | A | * | 8/1895 | Bowman | A45D 40/02 401/62 |
| 1,712,840 | A | * | 5/1929 | Povel | A45D 40/02 401/55 |
| 1,978,193 | A | * | 10/1934 | Fulimer | A45D 40/02 401/83 |
| 1,983,083 | A | * | 12/1934 | Irelan | A45D 40/02 401/62 |
| 2,001,464 | A | * | 5/1935 | Kerr | A45D 40/02 401/51 |
| 2,043,250 | A | * | 6/1936 | Kasdan | A45D 40/02 401/84 |
| 5,800,086 | A | | 9/1998 | Piscopo | |

FOREIGN PATENT DOCUMENTS

| | | | | |
|---|---|---|---|---|
| WO | WO2007/043092 | * | 4/2007 | A45D 40/02 |
| WO | WO 2007/043092 | | 4/2007 | |

* cited by examiner

*Primary Examiner* — J C Jacyna
(74) *Attorney, Agent, or Firm* — Ted Masters

(57) ABSTRACT

An incremental advance dispenser includes a barrel which has a longitudinal axis, a muzzle end, and an opposite breach end. A shuttle is slidably connected to the barrel and movable with respect to the barrel along the longitudinal axis. A cup which carries a product is movable within the barrel along the longitudinal axis. The shuttle is positionable to an extended position toward the muzzle end of the barrel, and to a retracted position toward the breach end of the barrel. Movement of the shuttle to the extended position from the retracted position causes the cup to move an incremental distance toward the muzzle end of the barrel.

26 Claims, 12 Drawing Sheets

FIG. 7
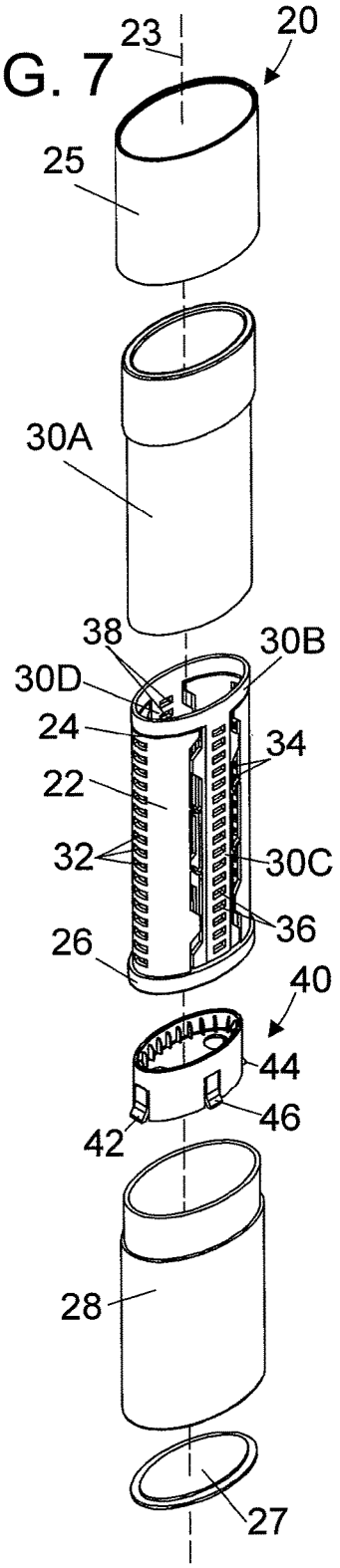
FIG. 8
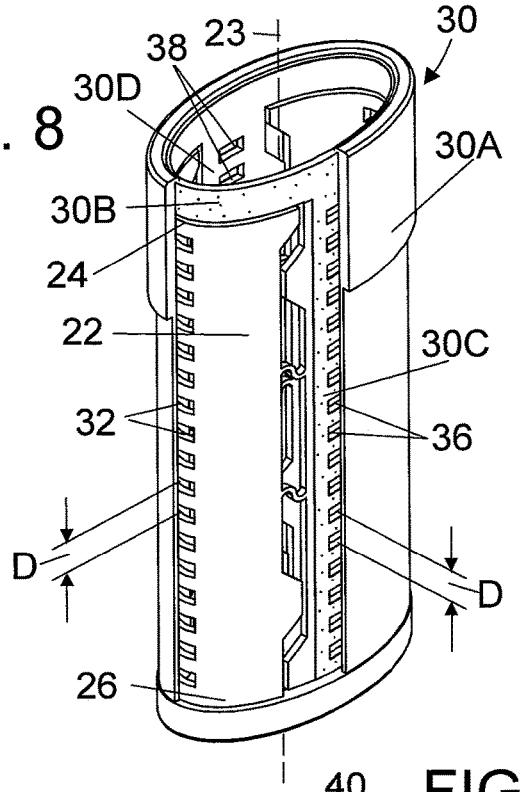
FIG. 9
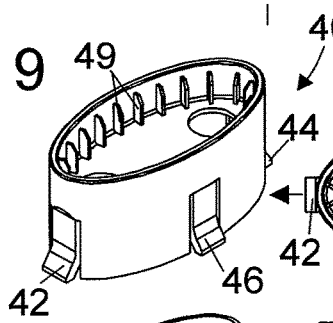
FIG. 10
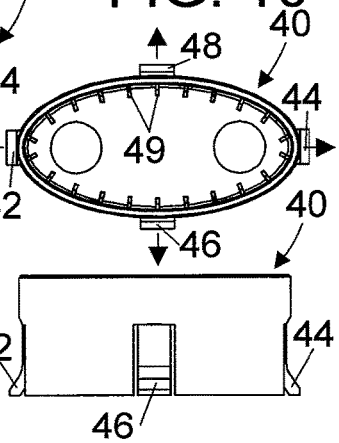
FIG. 11
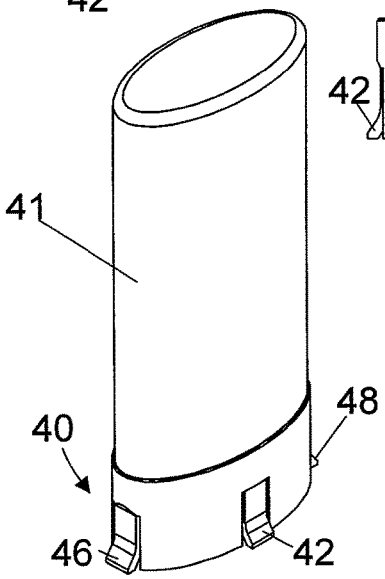
FIG. 12

FIG. 36
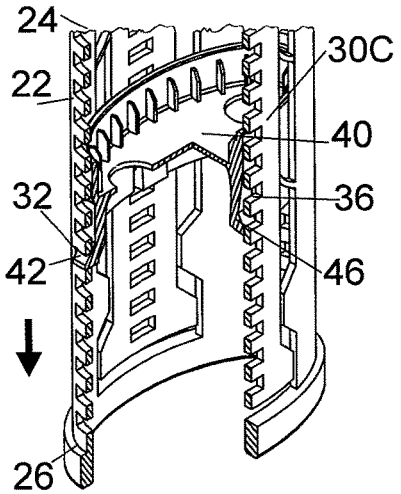
FIG. 37
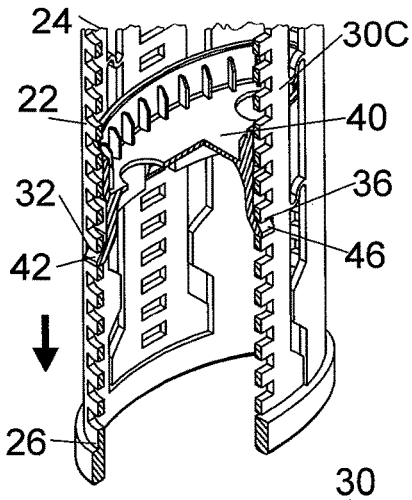
FIG. 38
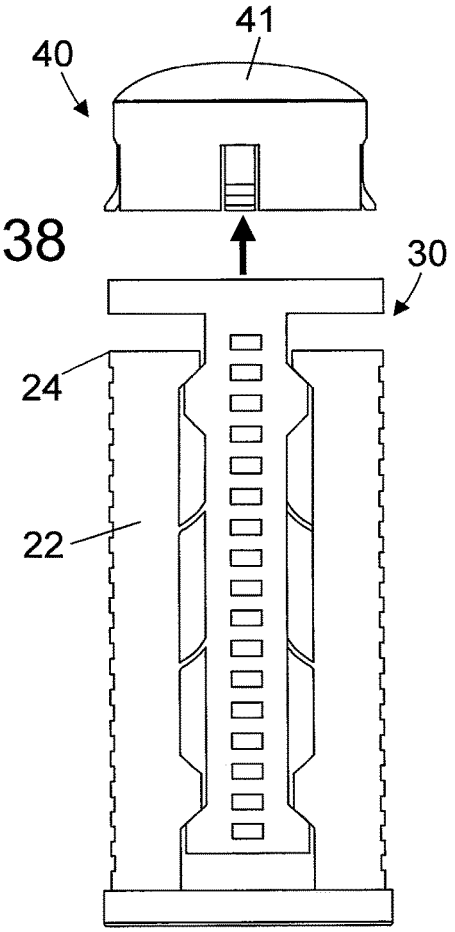
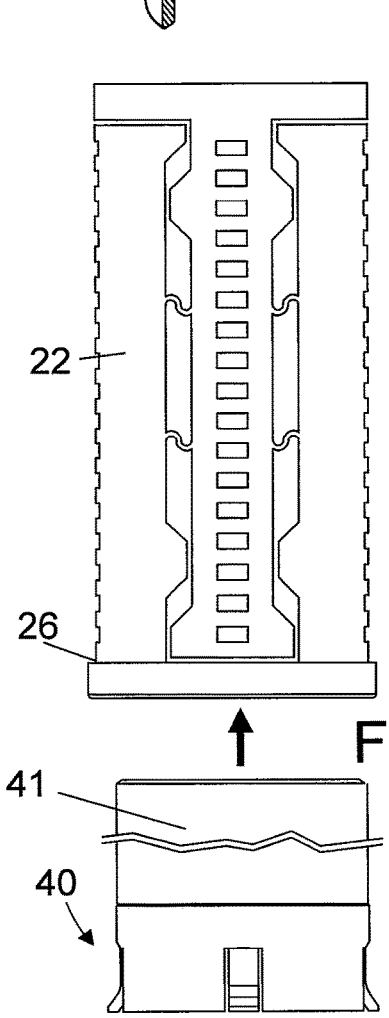
FIG. 39

FIG. 44
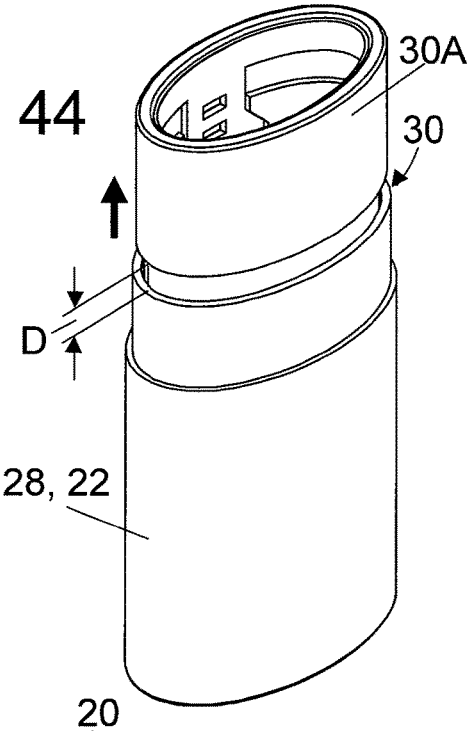
FIG. 45
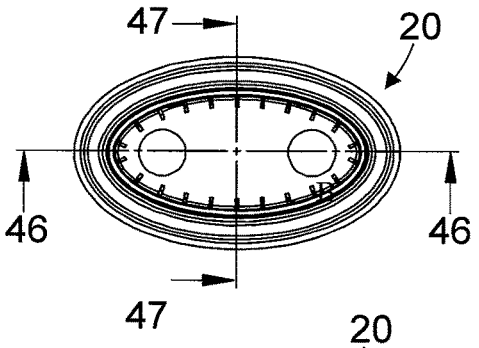
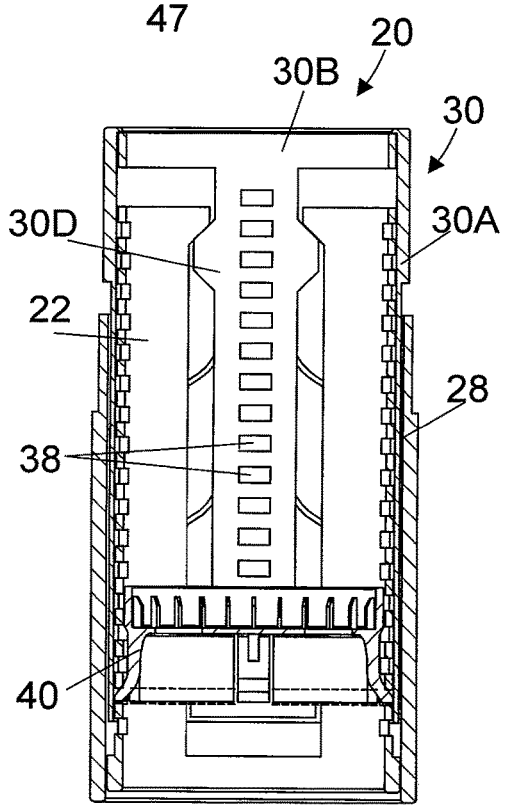
FIG. 46
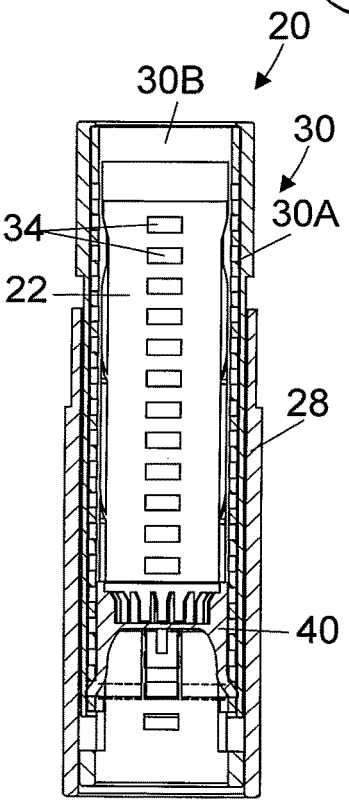
FIG. 47

FIG. 48
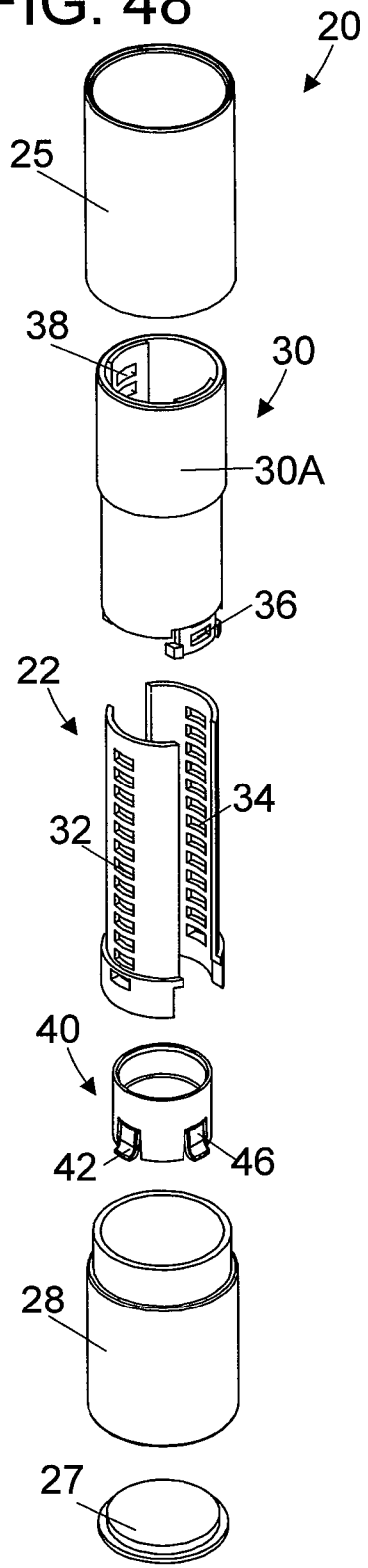
FIG. 49
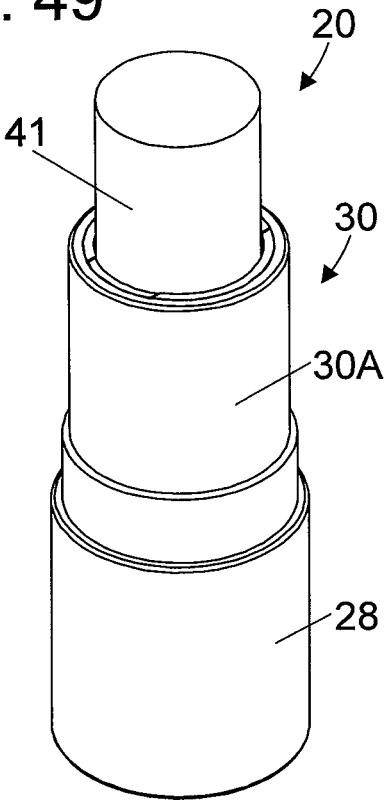
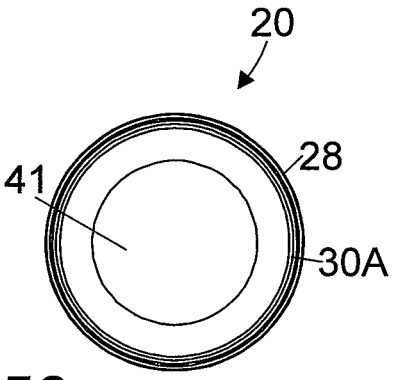
FIG. 50

INCREMENTAL ADVANCE DISPENSER AND METHOD

CROSS REFERENCE TO RELATED APPLICATION

None

TECHNICAL FIELD

The present invention pertains generally to dispensers which dispense products, and more particularly to a dispenser which advances the product an incremental distance each time a shuttle is moved from a retracted position to an extended position.

BACKGROUND OF THE INVENTION

Dispensers are well know in the art. The dispensers carry a product which is consumed over a number of uses. An example is a deodorant dispenser. As the product is consumed it must be periodically moved to permit further uses.

BRIEF SUMMARY OF THE INVENTION

The present invention is directed to an incremental advance dispenser which contains a product (also known as a bulk). The product can be any item which can be packaged in solid stick form. Examples are a deodorant, lipstick, other cosmetic or personal hygiene products, glue, a color application, etc. The product is loaded in the dispenser. As the product is consumed through use, it can be advanced an incremental distance to expose more product. The incremental advance is effected by a shuttle which moves from a retracted position to an extended. Each time the shuttle is moved from the retracted position to the extended position the product is advanced the incremental distance. The shuttle is then returned to the retracted position in preparation for the next cycle. Movement of the shuttle is the only action required to advance the product.

In accordance with an embodiment, an incremental advance dispenser includes a barrel having a longitudinal axis, a muzzle end, and an opposite breach end. A shuttle is slidably connected to the barrel and movable with respect to the barrel along the longitudinal axis. A cup which carries a product is movable within the barrel along the longitudinal axis. The shuttle is positionable to an extended position toward the muzzle end of the barrel, and to a retracted position toward the breach end of the barrel.

In accordance with another embodiment, movement of the shuttle to the extended position from the retracted position causes the cup to move an incremental distance toward the muzzle end of the barrel.

In accordance with another embodiment, the barrel has a first plurality of spaced-apart openings disposed parallel to the longitudinal axis and having an incremental distance between adjacent openings, and a second plurality of spaced-apart openings disposed parallel to the longitudinal axis and having the incremental distance between adjacent openings. The shuttle has a third plurality of spaced-apart openings disposed parallel to the longitudinal axis and having the incremental distance between adjacent openings, and a fourth plurality of spaced-apart openings disposed parallel to the longitudinal axis and having the incremental distance between adjacent openings. The cup has a first pawl which engages one of the first plurality of spaced-apart openings, a second pawl which engages one of the second plurality of spaced-apart openings, a third pawl which engages one of the third plurality of spaced-apart openings, and a fourth pawl engages one of the fourth plurality of spaced-apart openings. The cup is ejectable from the barrel from the muzzle end, and the cup is insertable into the barrel from the breach end.

In accordance with another embodiment, the cup is retained in position within the barrel by the first pawl engaging one of the first plurality of spaced-apart openings, and the second pawl engaging one of the second plurality of spaced-apart openings.

In accordance with another embodiment, the first plurality of spaced-apart openings contrapositioned with the second plurality of spaced-apart openings, and the third plurality of spaced-apart openings contrapositioned with the fourth plurality of spaced-apart openings. The first plurality of spaced-apart openings and the second plurality of spaced-apart openings define a first axis, and the third plurality of spaced-apart openings and the fourth plurality of spaced-apart openings define a second axis. The second axis is perpendicular to the first axis.

In accordance with another embodiment, the first pawl, the second pawl, the third pawl, and the fourth pawl each are resiliently biased to an outward position.

In accordance with another embodiment, the shuttle includes a sleeve, an elongated member, and a second elongated member. The third plurality of spaced-apart openings are carried by the elongated member, and the fourth plurality of spaced-apart openings are carried by the second elongated member.

In accordance with another embodiment, the barrel has an elongated aperture and an opposite second elongated aperture. The elongated member is shaped and dimensioned to be received by the elongated aperture, and the second elongated member is shaped and dimensioned to be received by the second elongated aperture.

In accordance with another embodiment, the elongated member has a protrusion, and the second elongated member has a second protrusion. The barrel has a stop and a second stop. In the extended position of the shuttle, the stop and the second stop engage the protrusion and the second protrusion respectively and limit movement of the shuttle to the incremental distance.

In accordance with another embodiment, the elongated member and the second elongated member are connected to the barrel by a plurality of flexible bridges.

In accordance with another embodiment, the elongated member and the second elongated member are connected to the sleeve by an adhesive.

Other embodiments, in addition to the embodiments enumerated above, will become apparent from the following detailed description, taken in conjunction with the accompanying drawings, which illustrate, by way of example, the principles of the incremental advance dispenser and method.

BRIEF DESCRIPTION OF THE DRAWINGS

FIG. 7 is a reduced exploded perspective view of the incremental advance dispenser;

FIG. 8 is a cutaway perspective view of a barrel and a shuttle;

FIG. 9 is a perspective view of a cup;

FIG. 10 is a top plan view of the cup;

FIG. 11 is a side elevation view of the cup;

FIG. 12 is a perspective view of the cup with a product installed;

FIG. 36 is a fragmented perspective view of the shuttle, barrel, and cup moved half way toward the retracted position;

FIG. 37 is a fragmented perspective view of the shuttle, barrel, and cup with the shuttle in the retracted position;

FIG. 38 is a fragmented front elevation view showing the cup being ejected from the muzzle end of the barrel;

FIG. 39 is a fragmented front elevation view showing the cup being inserted into the breach end of the barrel;

FIG. 44 is a perspective view of the incremental dispenser with the shuttle in the extended position;

FIG. 45 is a top plan view of FIG. 42;

FIG. 46 is a cross sectional view along the line 44-44 of FIG. 43;

FIG. 47 is a cross sectional view along the line 45-45 of FIG. 43;

FIG. 48 is an exploded reduced perspective view of a second embodiment;

FIG. 49 is a perspective view of the second embodiment with the cap removed; and, FIG. 50 is a top plan view of the second embodiment.

DETAILED DESCRIPTION OF THE INVENTION

Figure 1:
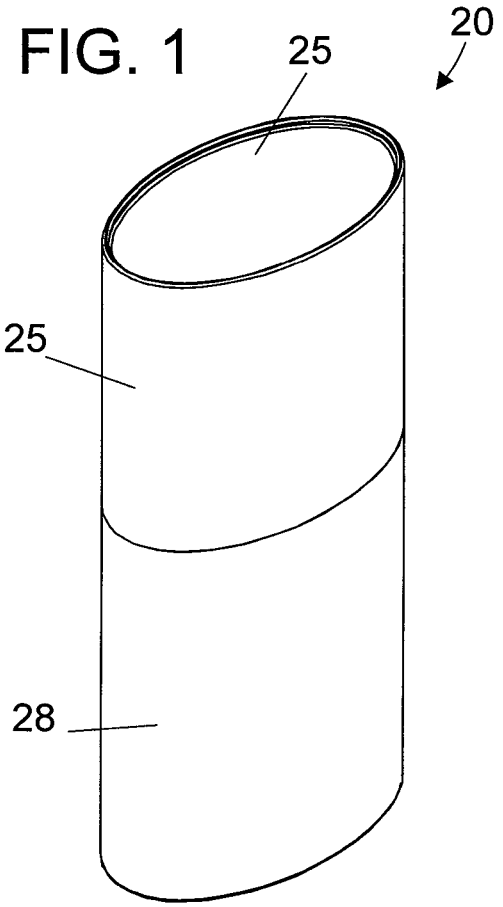
FIG. 1 is a perspective view of an incremental advance dispenser with a cap.
Figure 2:
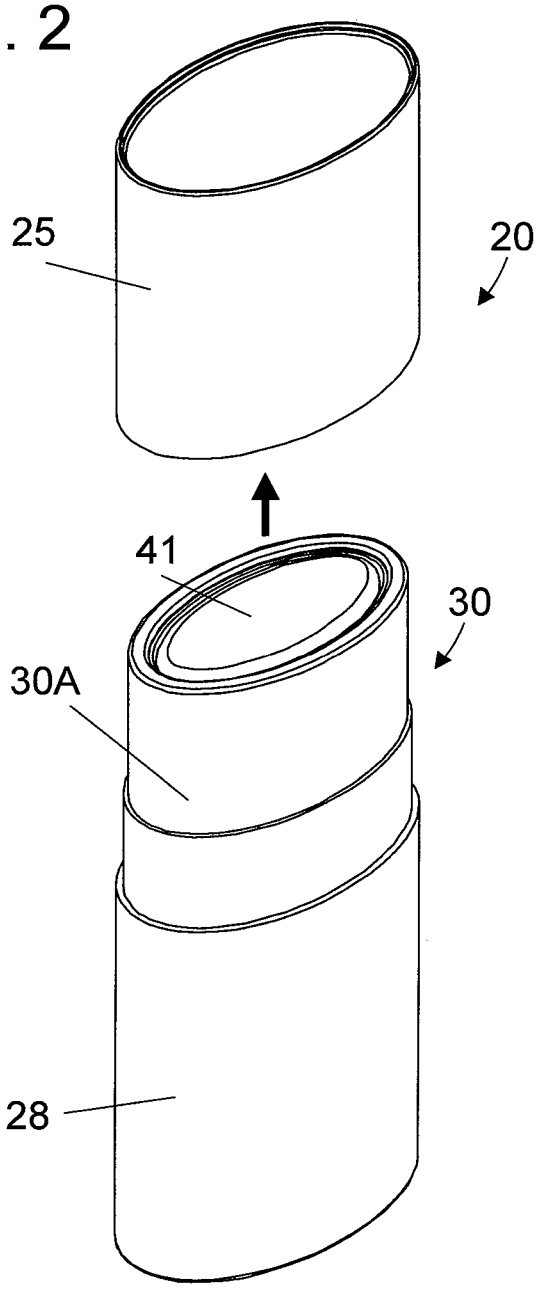
FIG. 2 is a view of the incremental advance dispenser with the cap removed.

Referring initially to FIGS. 1-7, there are illustrated several views of an incremental advance dispenser generally designated as 20. A barrel 22 has a longitudinal axis 23, a muzzle end 24, and an opposite breach end 26. A base 28 is connected to breach end 26 of barrel 22. A shuttle 30 is slidably connected to barrel and movable with respect to barrel 22 along longitudinal axis 23. Referring to FIGS. 8 and 26-28 it is noted that barrel 22 has a first plurality of spaced-apart openings 32 disposed parallel to longitudinal axis 23 and having an incremental distance D between adjacent openings. Barrel 22 also has a second plurality of spaced-apart openings 34 (refer to FIG. 26) disposed parallel to longitudinal axis 23 and having incremental distance D between adjacent openings. Incremental distance D can vary for specific applications (e.g. 0.125 inches, 0.250 inches, etc).

Referring specifically to FIGS. 8 and 17-19 it is noted that shuttle 30 includes a third plurality of spaced-apart openings 36 disposed parallel to longitudinal axis 23 and having incremental distance D between adjacent openings, and a fourth plurality of spaced-apart openings 38 disposed parallel to longitudinal axis 23 and having incremental distance D between adjacent openings. It is further noted that incremental advance dispenser 20 includes a removable cap 25, and a plug 27 which selectively covers breach end 28 of barrel 22. It is noted that plurality of openings 32, 34, 36, and 38 each have the same number of individual openings (17 in the shown embodiment).

Also referring to FIGS. 9-12, incremental advance dispenser 20 further includes a cup 40 which carries a product 41. It is noted that in most of the drawings contained herein product 41 has not been shown to better illustrate the detailed operation of the incremental advance dispenser 20. Cup 40 is movable within barrel 22 along longitudinal axis 23. Cup 40 has a first pawl 42 which engages one of first plurality of spaced-apart openings 32, a second pawl 44 which engages one of second plurality of spaced-apart openings 34, a third pawl 46 which engages one of third plurality of spaced-apart openings 36, and a fourth pawl 48 which engages one of fourth plurality of spaced-apart openings 38. It is noted that when shuttle 30 is in the retracted position the first 32, second 34, third 36, and fourth 38 plurality of spaced-apart openings are aligned with each other along longitudinal axis 23. That is, for each opening of one of the pluralities there is a corresponding opening on each of the three other three pluralities. It is noted that first pawl 42, second pawl 44, third pawl 46, and fourth pawl 48 are each resiliently biased to an outward position (indicated by arrows in FIG. 10). Cup 40 further includes ribs 49 which secure product 41 in place.

Figure 3:
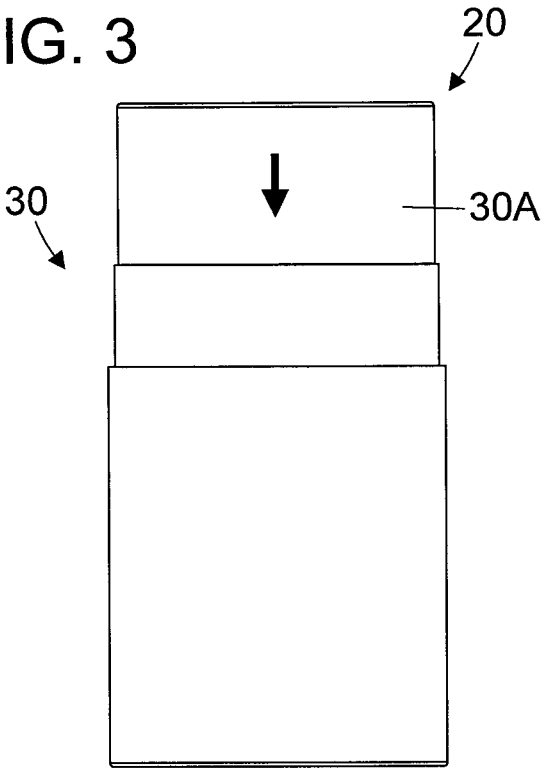
FIG. 3 is a side elevation view of the incremental advance dispenser placed in a retracted position.
Figure 4:
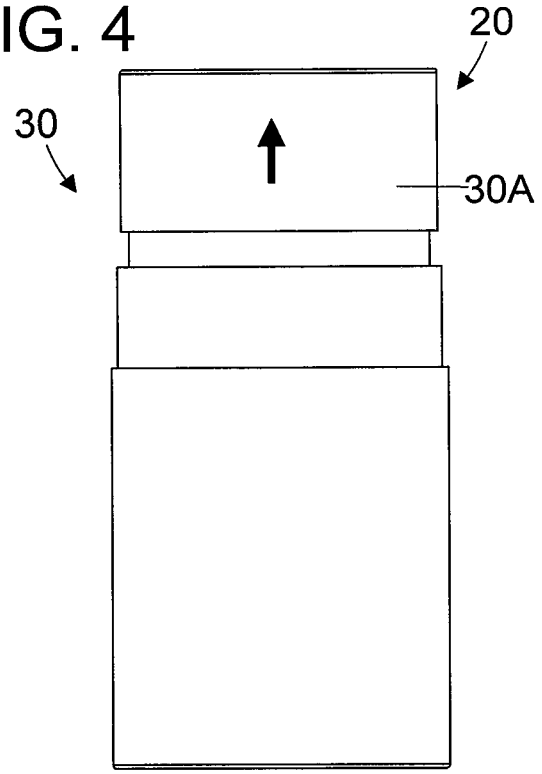
FIG. 4 is a side elevation view of the incremental advance dispenser placed in an extended position.
Figure 5:
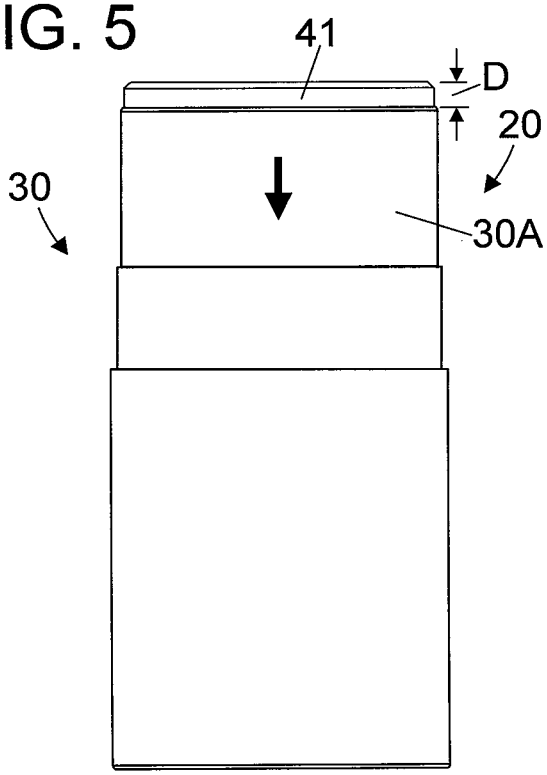
FIG. 5 is a side elevation view of the incremental advance dispenser returned to the retracted position.
Figure 6:
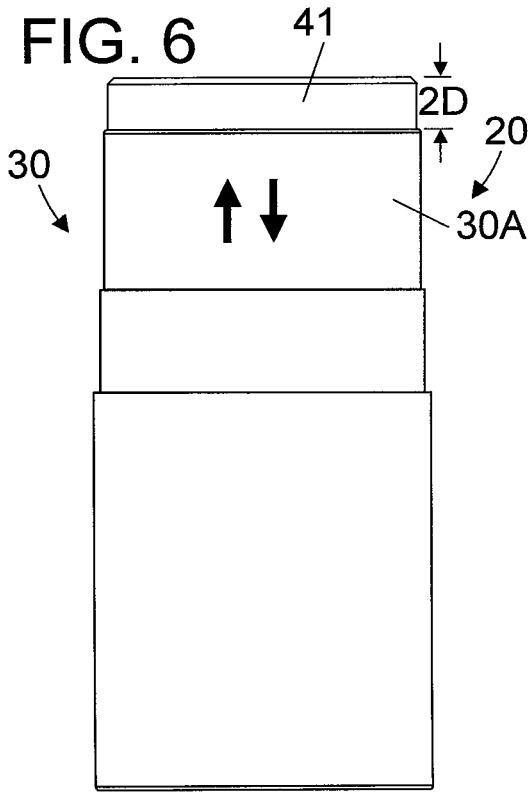
FIG. 6 is a side elevation view of the incremental advance dispenser after another extended-retracted cycle.

Referring to FIGS. 3-5, shuttle 30 is positionable to an extended position toward said muzzle end 24 of barrel 22 (FIG. 4), and to a retracted position toward breach end 26 of barrel. (FIGS. 2, 3, 5, and 6) Movement of shuttle 30 (by moving sleeve 30A, refer to FIGS. 7 and 8) to the extended position from the retracted position causes cup 40 (refer to FIGS. 7 and 9-12) to move the incremental distance D toward muzzle end 24 of barrel 22. Then movement of shuttle 30 back to the retracted position readies the incremental advance dispenser 20 for the next extended/retracted cycle. In FIG. 6, repeating the extended position/retracted position cycle results in movement of another incremental distance D so that the produce 41 now extends a distance 2D above shuttle 30. It is noted in the shown embodiment of FIGS. 1-47 incremental advance dispenser 20 has an elliptical shape, however other shapes such as circular (refer to FIGS. 48-50), rectangular, octagonal, or other polygon shapes are also possible.

Figure 13:
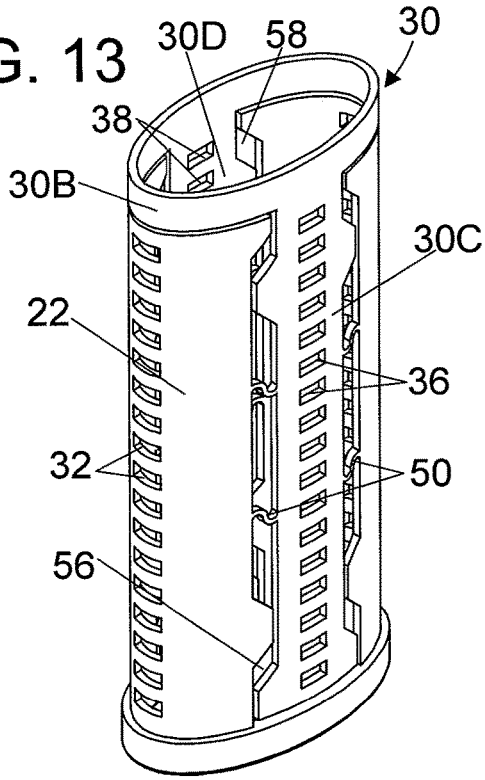
FIG. 13 is a fragmented perspective view of the barrel and a shuttle with the shuttle in the retracted position.
Figure 16:
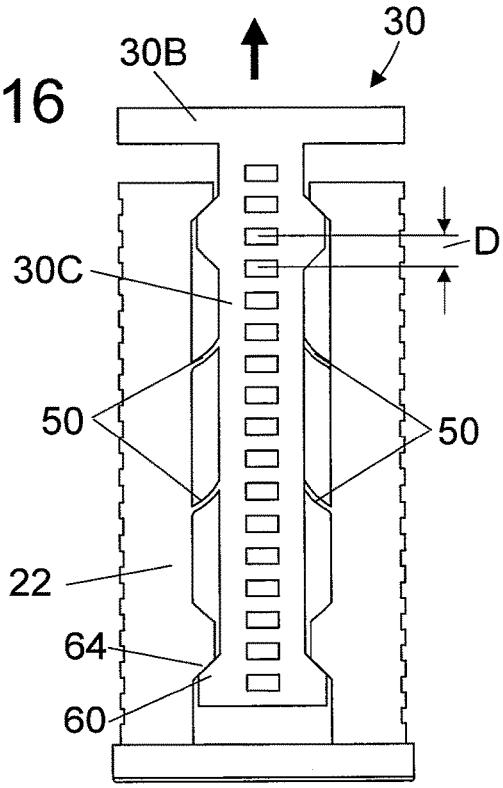
FIG. 16 is a fragmented front elevation view of FIG. 15.
Figure 17:
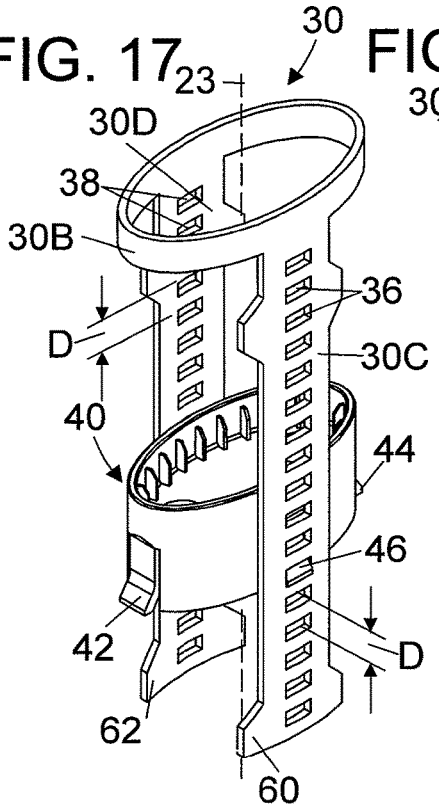
FIG. 17 is a fragmented perspective view of the shuttle and the cup with the shuttle in the retracted position of FIGS. 13 and 14.

Referring to FIG. 8 there is illustrated a cutaway perspective view of barrel 22 and shuttle 30 (also refer to FIGS. 13 and 17). In the shown embodiment shuttle 30 includes (1) a sleeve 30A, (2) a collar 30B, (3) third plurality of spaced-apart openings 36 which are carried by an elongated member 30C, and (4) fourth plurality of spaced apart openings 38 which are carried by a second elongated member 30D. In the shown embodiment sleeve 30A is connected to collar 30B and elongated member 30C and second elongated member 30D by an adhesive (depicted by small dots in FIG. 8) so that when sleeve 30A is moved along longitudinal axis 23 collar 30B, elongated member 30C, and second elongated member 30D also move along longitudinal axis 23. Also referring to FIGS. 13 and 16, in the shown embodiment elongated member 30C and second elongated member 30D are connected to barrel 22 by a plurality of flexible bridges 50. These bridges 50 flex to allow elongated members 30C and 30D to move along longitudinal axis 23 with respect to barrel 22. It may be appreciated however, that another embodiment can include no flexible bridges, wherein the shuttle 30 is not physically connected to the barrel 22 (refer to FIG. 48 and the associated discussion).

Figure 41:
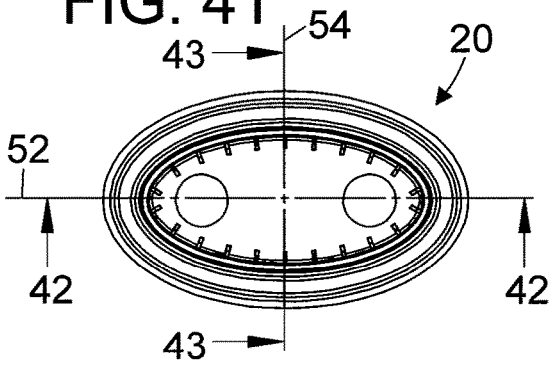
FIG. 41 is a top plan view of FIG. 40.

Referring also to FIG. 41, first plurality of spaced-apart openings 32 are contrapositioned with second plurality of spaced-apart openings 34, and third plurality of spaced-apart openings 36 are contrapositioned with fourth plurality of spaced-apart openings 38. First plurality of spaced-apart openings 32 and second plurality of spaced-apart openings 34 defining a first axis 52, and third plurality of spaced-apart openings 36 and fourth plurality of spaced-apart openings 38 define a second axis 54, second axis 54 is perpendicular to first axis 52.

Figure 14:
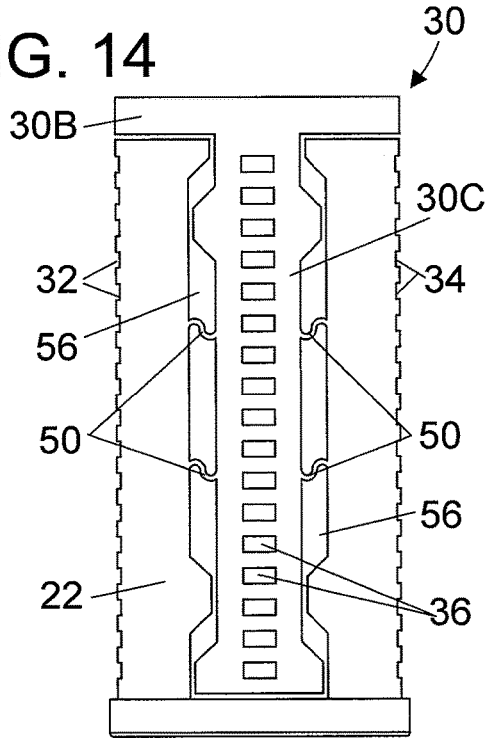
FIG. 14 is a fragmented front elevation view of FIG. 13.
Figure 15:
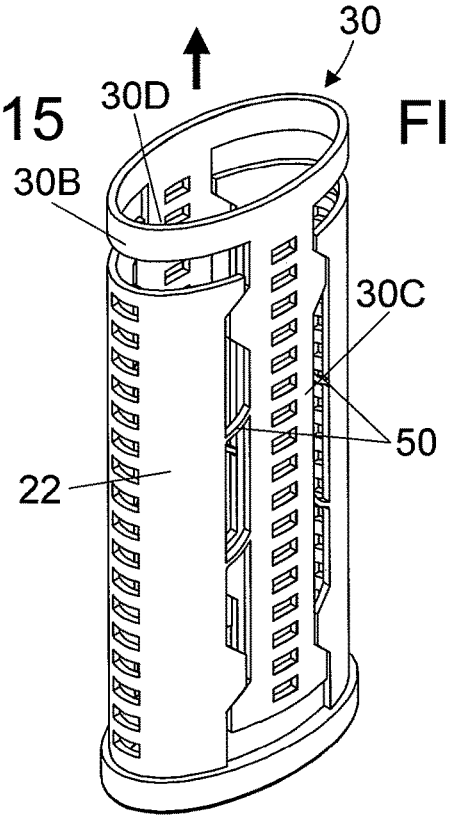
FIG. 15 is a fragmented perspective view of the barrel and shuttle with the shuttle in the extended position.

FIG. 13 is a fragmented perspective view of barrel 22 and shuttle 30 with shuttle 30 in the retracted position, and FIG. 14 is a fragmented front elevation view of FIG. 13. It is noted that the sleeve portion 30A of shuttle 30 has not been shown in order to clarify the description. These views as well as FIGS. 15 and 16 show the relationship between barrel 22 and shuttle 30. It is the movement (up and down as shown) of shuttle 30 with respect to barrel 22 which produces the incremental advance feature of the present dispenser. Third plurality of spaced-apart openings 36 are carried by elongated member 30C, and fourth plurality of space-apart openings 38 are carried by second elongated member 30D. Collar 30B is connected to elongated member 30C and to second elongated member 30D.

FIGS. 13 and 14 show shuttle 30 in the retracted position, and FIGS. 15 and 16 show shuttle 30 in the extended position. Barrel 22 has an elongated aperture 56 and an opposite second elongated aperture 58. It is noted that in FIG. 14 aperture 56 is in the foreground, while second aperture 58 is in the background since it is on the back side of the view. Elongated member 30C is shaped and dimensioned to be received by elongated aperture 56, and second elongated member 30D shaped and dimensioned to be received by second elongated aperture 58. Elongated member 30C has a protrusion 60, and second elongated member 30D has a second protrusion 62 (refer to FIG. 17). Barrel 22 has a stop 64, and a second stop 66 (refer to FIG. 33). In the extended position of shuttle 30 (FIG. 16), stop 64 engages protrusion 60 and second stop 66 engages second protrusion 62 thereby limiting movement of shuttle 30 to incremental distance D. It is noted in the shown embodiment, four protrusion/stop pairs are provided. It is the incremental distance D movement caused by elongated member 30C and second elongated member 30D that urges cup 40 toward muzzle end 24 of barrel 22. It is noted that flexible bridges 50 flex when elongated member 30C and elongated member 30D move with respect to barrel 22.

Figure 18:
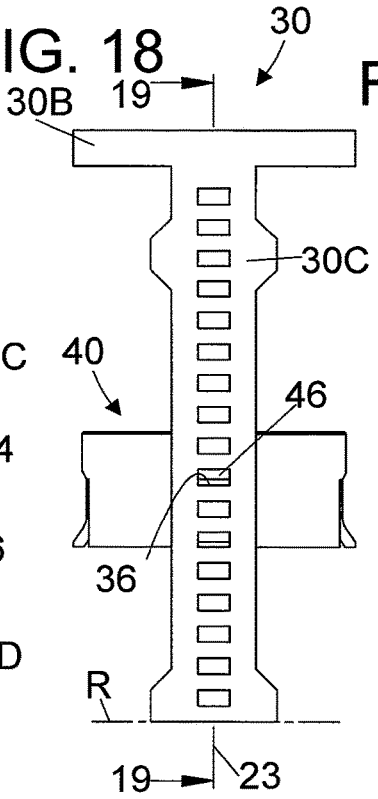
FIG. 18 is a front elevation view of FIG. 17.
Figure 19:
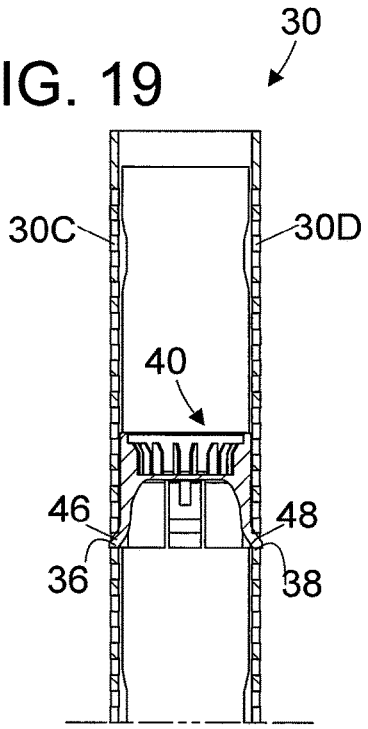
FIG. 19 is a cross sectional view along the line 19-19 of FIG. 18.

FIGS. 17-25 show how the movement of shuttle 30 moves cup 40. These are fragmented views in which only certain elements are show for clarity. Specifically sleeve 30A (refer to FIG. 8) has been eliminated. In FIGS. 17-19 shuttle 30 is in the retracted position. Third pawl 46 engages one of the third plurality of spaced-apart openings 36 which are carried by elongated member 30C, and fourth pawl 48 engages one of the fourth plurality of spaced-apart openings 38 which are carried by second elongated member 30D. In the shown embodiment the pawls start out in the sixth opening up from the bottom of elongated member 30C and second elongated member 30D as indexed by reference line R.

Figure 20:
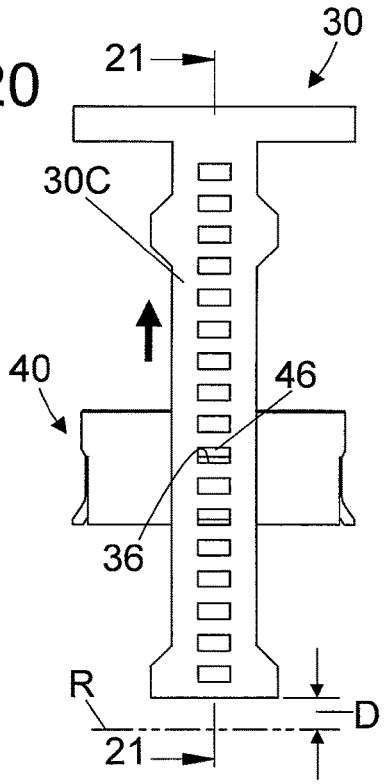
FIG. 20 is a fragmented front elevation view of the shuttle and the cup with the shuttle placed in the extended position.
Figure 21:
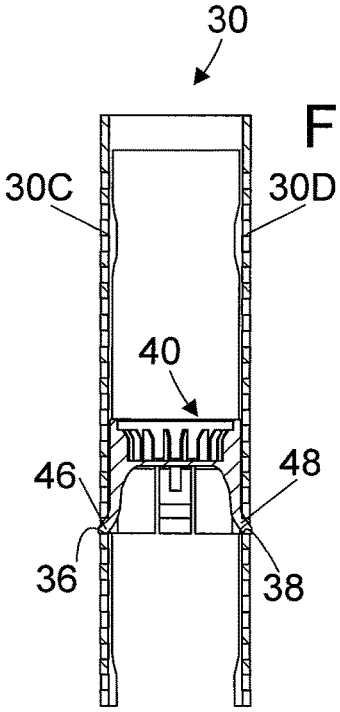
FIG. 21 is a cross sectional view along the line 21-21 of FIG. 20.

In FIGS. 20-21 shuttle 30 has been moved from the retracted position of FIGS. 17-19 to the extended position wherein cup 40 has been moved incremental distance D toward the muzzle end 24 of barrel 22 (refer to FIG. 8). Because pawls 46 and 48 engage openings 36 and 38 respectively, cup 40 (and the product 41) is also moved incremental distance D toward the muzzle end 24 of barrel 22. In the extended position cup is then locked in place by pawl 42 engaging one of first plurality of openings in barrel 22, and pawl 44 engaging one of second plurality of openings in barrel 22 (refer to FIGS. 26-32 and the associated discussion).

Figure 22:
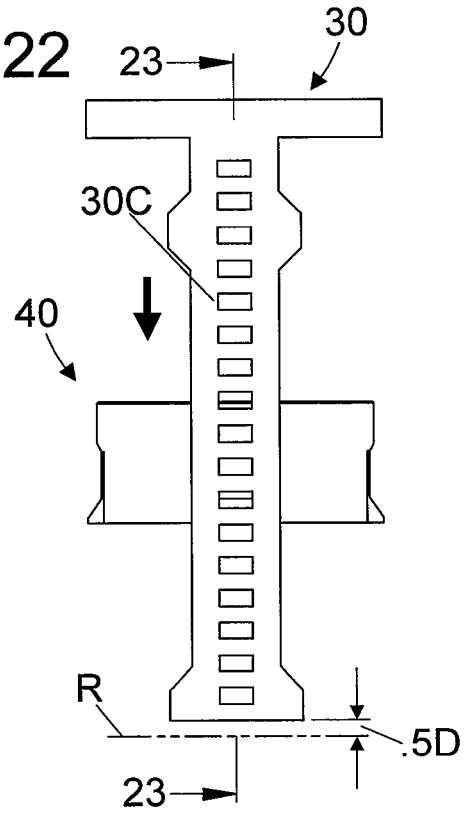
FIG. 22 is a fragmented front elevation view of the shuttle being moved from the extended position to the retracted position.
Figure 23:
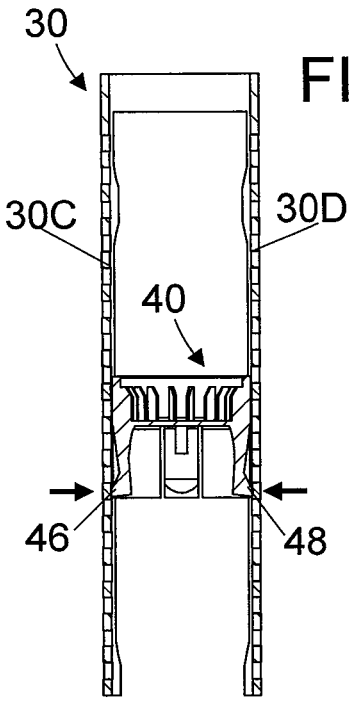
FIG. 23 is a cross sectional view along the line 23-23 of FIG. 22.
Figure 24:
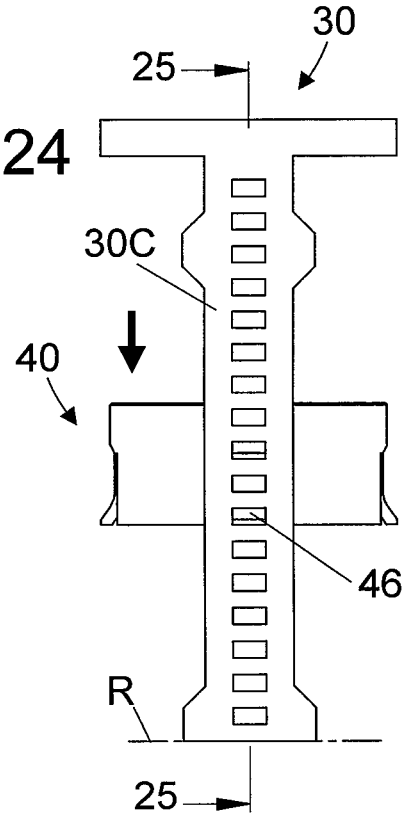
FIG. 24 is a fragmented front elevation view of the shuttle in the retracted position.
Figure 25:
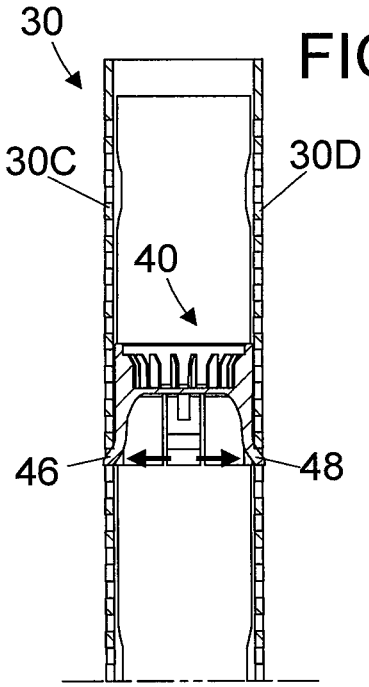
FIG. 25 is a cross sectional view along the line 25-25 of FIG. 24.

In FIGS. 22 and 23 shuttle 30 has been moved half way back (0.5D) from the extended position of FIGS. 20 and 21 to the retracted position. Because cup 40 is locked in place by pawls 42 and 44, when shuttle 30 is returned to the retracted position pawls 46 and 48 are forced inward by moving elongated member 30C and second elongated member 30D respectively. Finally in FIGS. 24 and 25 shuttle 30 is moved all the way to the retracted position. Pawls 46 and 48 resiliently enter the seventh openings from the bottom as indexed by reference line R. In a similar manner cup 40 is moved by one opening along elongated member 30C and second elongated member 30D each time shuttle is cycled from the retracted position to the extended position and back to the retracted position.

Figure 26:
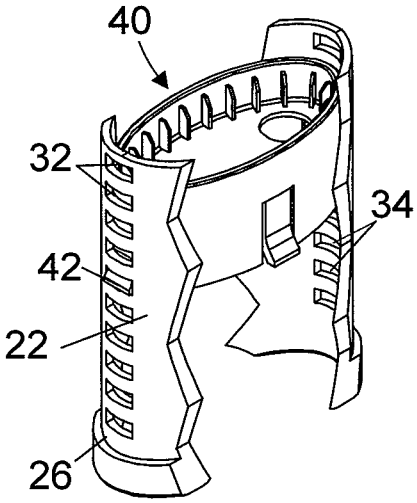
FIG. 26 is a fragmented perspective view of the barrel and the cup with the shuttle in the retracted position of FIGS. 17-19.
Figure 27:
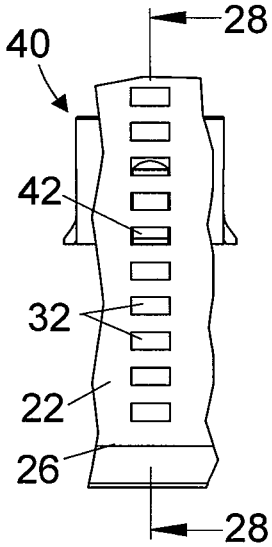
FIG. 27 is a fragmented side elevation view of FIG. 26.
Figure 28:
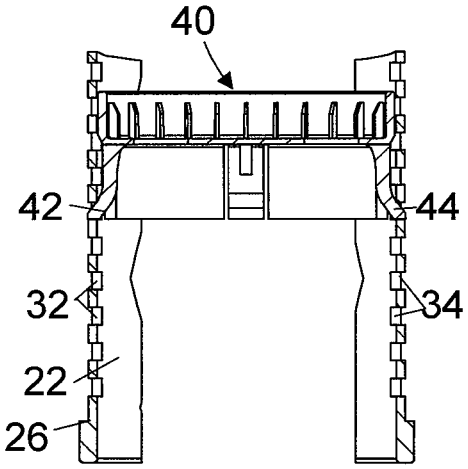
FIG. 28 is a cross sectional view along the line 28-28 of FIG. 27.

FIGS. 26-32 show the movement of cup 40 with respect to barrel 22. As with FIGS. 17-25 these are fragmented views in which only certain elements are show for clarity. Specifically only cup 40 and a portion of barrel 22 are shown. In FIGS. 26-28 shuttle 30 is in the retracted position, and corresponds with the position of FIGS. 17-19. Cup 40 is retained in position within barrel 22 by first pawl 42 engaging one of the first plurality of spaced-apart openings 32, and second pawl 44 engaging one of the second plurality of spaced-apart openings 34. The pawls 42 and 44 are in the sixth hole from the breach end 26 of barrel 22. Referring to FIGS. 17-19, since the four plurality of spaced-apart openings are longitudinally aligned in the retracted position of shuttle 30, it is noted that third pawl 36 and fourth pawl 38 are also in the sixth hole of elongated members 30C and 30D.

Figure 29:
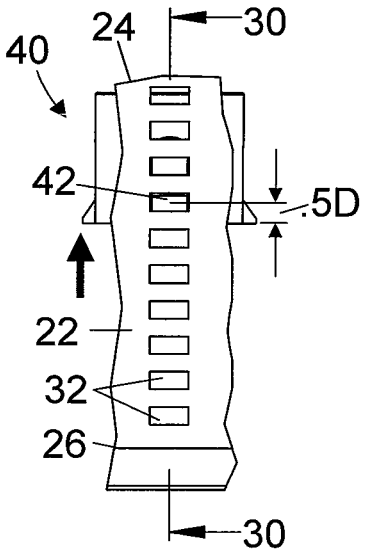
FIG. 29 is a fragmented side elevation view of the barrel and cup with the shuttle being moved from the retracted position of FIGS. 17-19 to the extended position of FIGS. 20 and 21.
Figure 30:
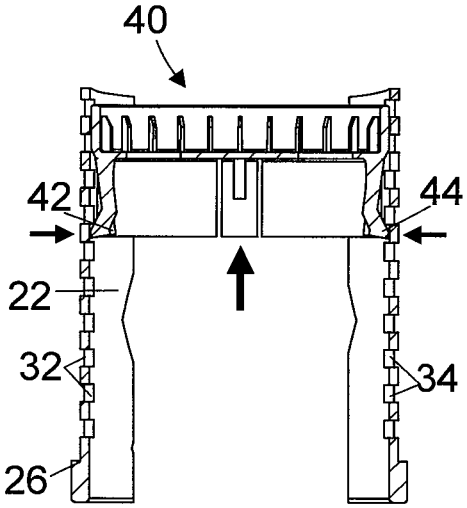
FIG. 30 is a cross sectional view along the line 30-30 of FIG. 29.
Figure 31:
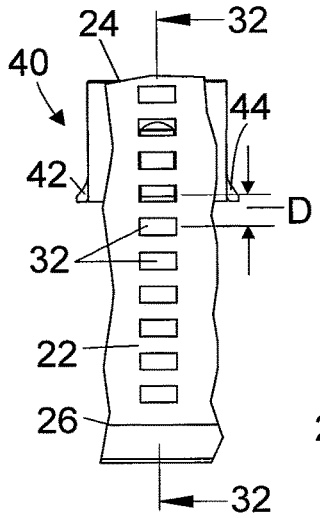
FIG. 31 is a fragmented side elevation view of the barrel and cup with the shuttle in the extended position of FIGS. 20 and 21.
Figure 32:
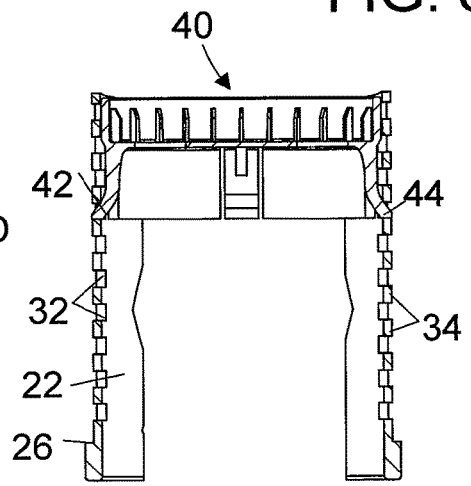
FIG. 32 is a cross sectional view along the line 32-32 of FIG. 31.

In FIGS. 29 and 30 shuttle 30 has moved cup 40 from the retracted position of FIGS. 26-28 half way (0.5D) to the extended position (refer to FIGS. 31 and 32). First pawl 42 and second pawl 44 are forced inward by first plurality of spaced-apart openings 32 and second plurality of spaced-apart openings 34 respectively as the pawls move from the sixth position toward the seventh position. Cup is moved because shuttle 30 is moved and pawls 46 and 48 engage openings 36 and 38 respectively (refer to FIGS. 17-25). Therefore cup 40 (and the product 41) is also moved toward the muzzle end 24 of barrel 22

Figure 33:
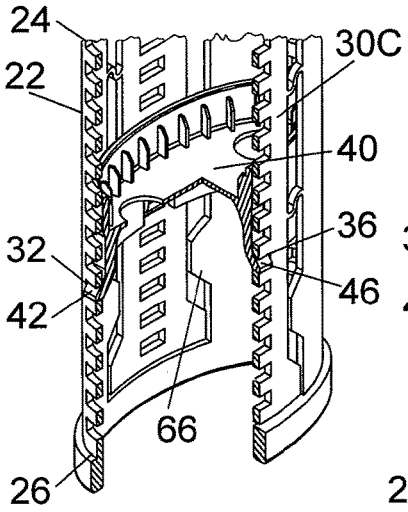
FIG. 33 is a fragmented perspective view of the shuttle, barrel, and cup with the shuttle in the retracted position.

In FIGS. 31 and 32 shuttle 30 has moved incremental distance D all the way to the extended position. First 42 pawl and second pawl 44 now resided in the seventh openings 32 and 34 respectively. In a similar fashion cup 40 is moved toward muzzle en 24 of barrel 22 each time shuttle 30 is moved from the retracted position to the extended position FIG. 33 through 37 are fragmented perspective views of the shuttle 30, barrel 22, and cup 40 which show the sequence of operation previously described in FIGS. 17-32. In FIG. 33 shuttle 30 (elongated member 30C) is in the retracted position. First pawl 42 of cup 40 is in the sixth spaced-apart openings 32 from the breach end 26 of barrel 22. Third pawl 46 is in the sixth spaced-apart openings 36 from the breach end 26 of barrel 22. This position corresponds to FIGS. 17-19 and FIGS. 26-28.

Figure 34:
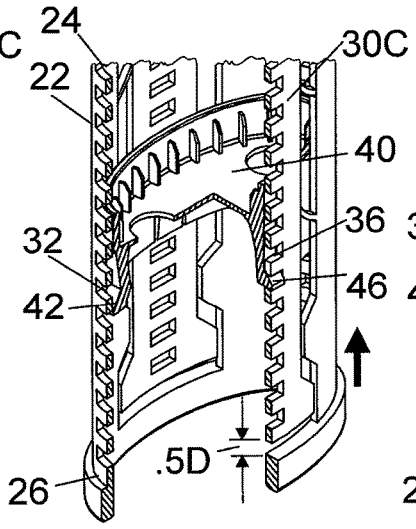
FIG. 34 is a fragmented perspective view of the shuttle, barrel, and cup with the shuttle moved half way toward the extended position.

In FIG. 34 shuttle 30 has moved half way (0.5D) toward the muzzle end 24 of barrel 22. First pawl 42 is half way between the sixth position and the seventh position of spaced-apart openings 32, and third pawl 46 remains in the sixth spaced-apart openings 36. This position corresponds to that of FIGS. 29-30.

Figure 35:
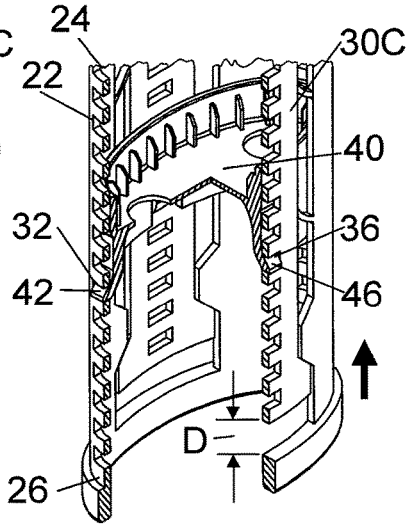
FIG. 35 is a fragmented perspective view of the shuttle, barrel, and cup with the shuttle in the extended position.

In FIG. 35 shuttle 30 has moved all the way to the extended position. First pawl 42 is in the seventh spaced-apart opening 32, and third pawl 46 remains in the sixth spaced-apart openings 36. This position corresponds to FIGS. 20 and 21, and FIGS. 31 and 32.

In FIG. 36 shuttle 30 has moved half way back (0.5D) toward the breach end 26 of barrel 22. Third pawl 46 is half way between the sixth position and the seventh position of spaced-apart openings 36. This position corresponds to that of FIGS. 22 and 23.

In FIG. 37 shuttle 30 is in the retracted position. First pawl 42 and third pawl 46 are both in the seventh position. This position corresponds to FIGS. 24 and 25, and FIGS. 31 and 32.

FIG. 38 is a fragmented front elevation view showing cup 40 being ejected from the muzzle end 24 of barrel 22. This typically happens when the product 41 has been consumed, and a new product is needed. To do this, the shuttle 30 is cycled between the retracted and extended positions until cup 40 leaves the muzzles last set of spaced-apart openings and can be removed.

FIG. 39 is a fragmented front elevation view showing cup 40 with product 41 being inserted into the breach end 26 of barrel 22. In this manner a new unused cup 40 with product 41 can be inserted into the dispenser. It is noted that cup 40 moves in only one direction, toward muzzle end 24 of barrel 22. Movement of cup 40 toward breach end 26 is not possible.

Figure 40:
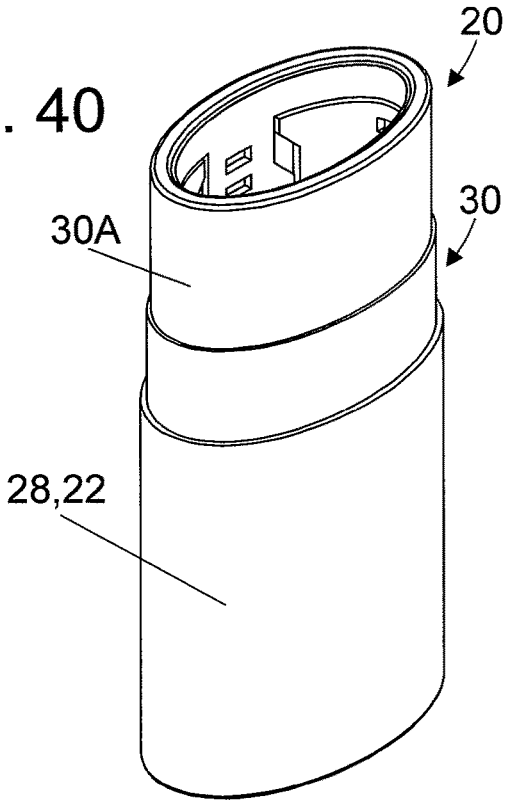
FIG. 40 is a perspective view of the incremental dispenser with the shuttle in the retracted position.
Figure 42:
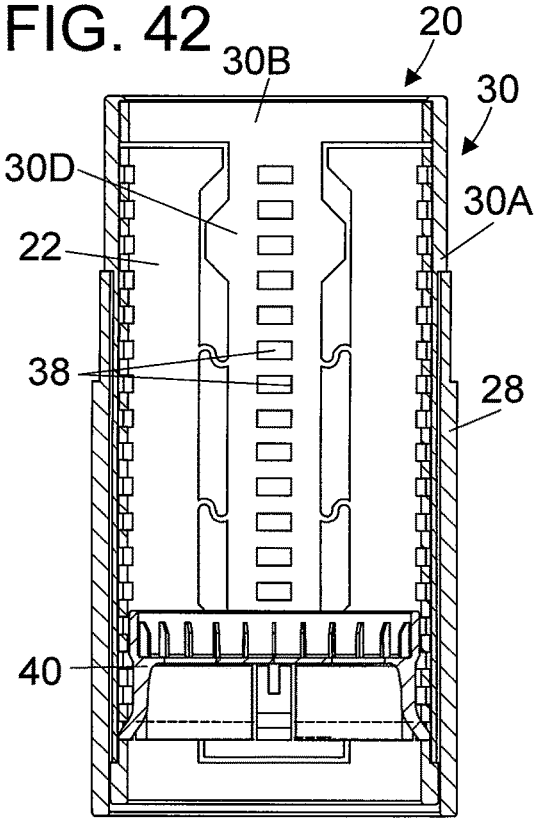
FIG. 42 is a cross sectional view along the line 42-42 of FIG. 41.
Figure 43:
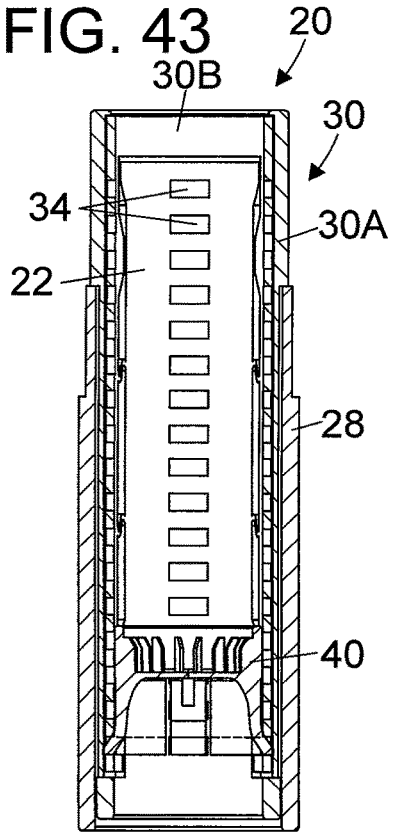
FIG. 43 is a cross sectional view along the line 43-43 of FIG. 41.

FIGS. 40-41 are perspective and top plan views respectively of incremental advance dispenser 20 with shuttle 30 in the retracted position. FIG. 42 is a cross sectional view along the line 42-42 of FIG. 41, and FIG. 43 is a cross sectional view along the line 43-43 of FIG. 41. Shown are barrel 22, base 28, shuttle 30, collar 30B, second elongated member 30D, second plurality of space-apart openings 34, fourth plurality of space-apart openings 38, and cup 40.

FIGS. 44-45 are perspective and top plan views respectively of incremental advance dispenser 20 with shuttle 30 in the extended position. FIG. 46 is a cross sectional view along the line 46-46 of FIG. 45, and FIG. 47 is a cross sectional view along the line 47-47 of FIG. 45. Shown are incremental distance D, barrel 22, base 28, shuttle 30, collar 30B, second elongated member 30D, second plurality of space-apart openings 34, fourth plurality of space-apart openings 38, and cup 40.

FIGS. 48-50 are reduced exploded perspective, perspective, and top plan views respectively of a second embodiment of incremental advance dispenser 20. In this embodiment incremental advance dispenser 20 has a circular shape (refer to FIG. 50) rather than the elliptical shape of the previous embodiment (refer to FIGS. 1, 2, 45, and 46). Another difference is that shuttle 30 and barrel 22 are not connected together by flexible fingers 50 (refer to FIGS. 13-16), however they still are slidably connected. Also third plurality of spaced apart openings 36 and fourth plurality of spaced-apart openings 38 are directly connected to sleeve 30A. As with the previous embodiment, barrel 22 is fixedly connected to base 28. The FIGS. show barrel, 22, cover 25, plug 27, base 28, shuttle 30, sleeve 30A, first plurality of spaced-apart openings 32, second plurality of spaced-apart openings 34, third plurality of spaced-apart openings 36, fourth plurality of spaced-apart openings 38, cup 40 first pawl 42, and third pawl 46.

In terms of use, a method for using a dispenser includes: (refer to FIGS. 1-50), (a) providing an incremental advance dispenser 20 including;

a barrel 22 having a longitudinal axis 23 a muzzle end 24 and an opposite breach end 26;

a shuttle 30 slidably connected to barrel 22 and movable with respect to the barrel 22 along the longitudinal axis 23;

a cup 40 which carries a product 41 is movable within the barrel 22 along the longitudinal axis 23;

the shuttle 30 positionable to an extended position toward the muzzle end 24 of the barrel 22, and to a retracted position toward the breach end 26 of the barrel 22;

(b) ensuring the shuttle 30 is in the retracted position; and, (c) moving the shuttle 30 to the extended position causing the cup 40 to move an incremental distance D toward the muzzle end 24 of the barrel 22.

The method further including:

repeating (b) and (c) a number of times.

The method further including:

repeating (b) and (c) until the cup 40 is ejected from the muzzle end 24 of the barrel 26.

The method further including:

before (c), loading the cup 40 in the barrel 22 from the breach end 26 of the barrel 22.

It is noted to effect the operation of the dispenser 20, a user grasps base 28 with the fingers of one hand, and grasps sleeve 30A of shuttle 30 with the fingers of the other hand. To place the shuttle 30 in the extended position, the user pulls the shuttle 30 away from the base 28, and to place the shuttle 30 in the retracted position the user pushes the shuttle toward the base 28.

The embodiments of the incremental advance dispenser and method described herein are exemplary and numerous modifications, combinations, variations, and rearrangements can be readily envisioned to achieve an equivalent result, all of which are intended to be embraced within the scope of the appended claims. Further, nothing in the above-provided discussions of the incremental advance dispenser and method should be construed as limiting the invention to a particular embodiment or combination of embodiments. The scope of the invention is defined by the appended claims.

I claim:

1. An incremental advance dispenser, comprising:

a barrel having a longitudinal axis, a first plurality of spaced-apart openings disposed parallel to said longitudinal axis and having an incremental distance between adjacent openings, a second plurality of spaced-apart openings disposed parallel to said longitudinal axis and having said incremental distance between adjacent openings, a muzzle end, and a breach end;

a shuttle slidably connected to said barrel and movable with respect to said barrel along said longitudinal axis, said shuttle having a third plurality of spaced-apart openings disposed parallel to said longitudinal axis and having said incremental distance between adjacent openings, and a fourth plurality of spaced-apart openings disposed parallel to said longitudinal axis and having said incremental distance between adjacent openings;

a cup which carries a product is movable within said barrel along said longitudinal axis, said cup having a first pawl which engages one of said first plurality of spaced-apart openings, a second pawl which engages one of said second plurality of spaced-apart openings, a third pawl which engages one of said third plurality of spaced-apart openings, and a fourth pawl engages one of said fourth plurality of spaced-apart openings; and, said shuttle positionable to an extended position toward said muzzle end of said barrel, and to a retracted position toward said breach end of said barrel.

2. The incremental advance dispenser according to claim 1, further including:

movement of said shuttle to said extended position from said retracted position causing said cup to move said incremental distance toward said muzzle end of said barrel.

3. The incremental advance dispenser according to claim 1, further including:

said cup retained in position within said barrel by said first pawl engaging one of said first plurality of spaced-apart openings, and said second pawl engaging one of said second plurality of spaced-apart openings.

4. The incremental advance dispenser according to claim 1, further including:

said first plurality of spaced-apart openings contrapositioned with said second plurality of spaced-apart openings;

said third plurality of spaced-apart openings contrapositioned with said fourth plurality of spaced-apart openings;

said first plurality of spaced-apart openings and said second plurality of spaced-apart openings defining a first axis;

said third plurality of spaced-apart openings and said fourth plurality of spaced-apart openings defining a second axis; and, said second axis being perpendicular to said first axis.

5. The incremental advance dispenser according to claim 1, further including:

said first pawl, said second pawl, said third pawl, and said fourth pawl each being resiliently biased to an outward position.

6. The incremental advance dispenser according to claim 1, further including:

said cup ejectable from said barrel from said muzzle end; and, said cup insertable into said barrel from said breach end.

7. The incremental advance dispenser according to claim 1, further including:

said shuttle including a sleeve, an elongated member, and a second elongated member;

said third plurality of spaced-apart openings carried by said elongated member; and, said fourth plurality of spaced-apart openings carried by said second elongated member.

8. The incremental advance dispenser according to claim 7, further including:

said barrel having an elongated aperture and an opposite second elongated aperture; and, said elongated member shaped and dimensioned to be received by said elongated aperture, and said second elongated member shaped and dimensioned to be received by said second elongated aperture.

9. The incremental advance dispenser according to claim 7, further including:

said elongated member having a protrusion, and said second elongated member having a second protrusion;

said barrel having a stop and a second stop; and, in said extended position of said shuttle, said stop and said second stop engaging said protrusion and said second protrusion respectively and limiting movement of said shuttle to said incremental distance.

10. The incremental advance dispenser according to claim 7, further including:

said elongated member and said second elongated member being connected to said barrel by a plurality of flexible bridges.

11. The incremental advance dispenser according to claim 7, further including:

said elongated member and said second elongated member connected to said sleeve by an adhesive.

12. The incremental advance dispenser according to claim 1, further including:

said cup retained in position within said barrel by said first pawl engaging one of said first plurality of spaced-apart openings, and said second pawl engaging one of said second plurality of spaced-apart openings;

said first plurality of spaced-apart openings contrapositioned with said second plurality of spaced-apart openings;

said third plurality of spaced-apart openings contrapositioned with said fourth plurality of spaced-apart openings;

said first plurality of spaced-apart openings and said second plurality of spaced-apart openings defining a first axis;

said third plurality of spaced-apart openings and said fourth plurality of spaced-apart openings defining a second axis;

said second axis being perpendicular to said first axis;

said first pawl, said second pawl, said third pawl, and said fourth pawl each being resiliently biased to an outward position;

said cup ejectable from said barrel from said muzzle end;

said cup insertable into said barrel from said breach end;

said shuttle including a sleeve, an elongated member, and a second elongated member;

said third plurality of spaced-apart openings carried by said elongated member;

said fourth plurality of spaced-apart openings carried by said second elongated member;

said barrel having an elongated aperture and an opposite second elongated aperture;

said elongated member shaped and dimensioned to be received by said elongated aperture, and said second elongated member shaped and dimensioned to be received by said second elongated aperture;

said elongated member having a protrusion, and said second elongated member having a second protrusion;

said barrel having a stop and a second stop;

in said extended position of said shuttle, said stop and said second stop engaging said protrusion and said second protrusion respectively and limiting movement of said shuttle to said incremental distance;

said elongated member and said second elongated member being connected to said barrel by a plurality of flexible bridges; and, said elongated member and said second elongated member connected to said sleeve by an adhesive.

13. A method for using a dispenser, comprising:

(a) providing an incremental advance dispenser including;

a barrel having a longitudinal axis, a first plurality of spaced-apart openings disposed parallel to said longitudinal axis and having an incremental distance between adjacent openings, a second plurality of spaced-apart openings disposed parallel to said longitudinal axis and having said incremental distance between adjacent openings, a muzzle end, and a breach end;

a shuttle slidably connected to said barrel and movable with respect to said barrel along said longitudinal axis, said shuttle having a third plurality of spaced-apart openings disposed parallel to said longitudinal axis and having said incremental distance between adjacent openings, and a fourth plurality of spaced-apart openings disposed parallel to said longitudinal axis and having said incremental distance between adjacent openings;

a cup which carries a product is movable within said barrel along said longitudinal axis, said cup having a first pawl which engages one of said first plurality of spaced-apart openings, a second pawl which engages one of said second plurality of spaced-apart openings, a third pawl which engages one of said third plurality of spaced-apart openings, and a fourth pawl engages one of said fourth plurality of spaced-apart openings; and, said shuttle positionable to an extended position toward said muzzle end of said barrel, and to a retracted position toward said breach end of said barrel;

(b) ensuring said shuttle is in said retracted position; and, (c) moving said shuttle to said extended position causing said cup to move an incremental distance toward said muzzle end of said barrel.

14. The method of claim 13, further including:

repeating (b) and (c) a number of times.

15. The method of claim 14, further including:

repeating (b) and (c) until said cup is ejected from said muzzle end of said barrel.

16. The method of claim 13, further including:

before (c), loading said cup in said barrel from said breach end of said barrel.

17. An incremental advance dispenser, comprising:

a barrel having a longitudinal axis a muzzle end and an opposite breach end;

a shuttle slidably connected to said barrel and movable with respect to said barrel along said longitudinal axis;

a cup which carries an application product is movable within said barrel along said longitudinal axis;

said shuttle positionable to an extended position toward said muzzle end of said barrel, and to a retracted position toward said breach end of said barrel;

said barrel having a first plurality of spaced-apart openings disposed parallel to said longitudinal axis and having an incremental distance between adjacent openings, a second plurality of spaced-apart openings disposed parallel to said longitudinal axis and having said incremental distance between adjacent openings;

said shuttle having a third plurality of spaced-apart openings disposed parallel to said longitudinal axis and having said incremental distance between adjacent openings, and a fourth plurality of spaced-apart openings disposed parallel to said longitudinal axis and having said incremental distance between adjacent openings;

said cup having a first pawl which engages one of said first plurality of spaced-apart openings, a second pawl which engages one of said second plurality of spaced-apart openings, a third pawl which engages one of said third plurality of spaced-apart openings, and a fourth pawl engages one of said fourth plurality of spaced-apart openings;

said cup ejectable from said barrel from said muzzle end; and, said cup insertable into said barrel from said breach end.

18. The incremental advance dispenser according to claim 17, further including:

movement of said shuttle to said extended position from said retracted position causing said cup to move an incremental distance toward said muzzle end of said barrel.

19. The incremental advance dispenser according to claim 17, further including:

said cup retained in position within said barrel by said first pawl engaging one of said first plurality of spaced-apart openings, and said second pawl engaging one of said second plurality of spaced-apart openings.

20. The incremental advance dispenser according to claim 17, further including:

said first plurality of spaced-apart openings contrapositioned with said second plurality of spaced-apart openings;

said third plurality of spaced-apart openings contrapositioned with said fourth plurality of spaced-apart openings;

said first plurality of spaced-apart openings and said second plurality of spaced-apart openings defining a first axis;

said third plurality of spaced-apart openings and said fourth plurality of spaced-apart openings defining a second axis; and, said second axis being perpendicular to said first axis.

21. The incremental advance dispenser according to claim 17, further including:

said first pawl, said second pawl, said third pawl, and said fourth pawl each being resiliently biased to an outward position.

22. The incremental advance dispenser according to claim 17, further including:

said shuttle including a sleeve, an elongated member, and a second elongated member;

said third plurality of spaced-apart openings carried by said elongated member; and, said fourth plurality of spaced-apart openings carried by said second elongated member.

23. The incremental advance dispenser according to claim 22, further including:

said barrel having an elongated aperture and an opposite second elongated aperture; and, said elongated member shaped and dimensioned to be received by said elongated aperture, and said second elongated member shaped and dimensioned to be received by said second elongated aperture.

24. The incremental advance dispenser according to claim 17, further including:

said elongated member having a protrusion, and said second elongated member having a second protrusion;

said barrel having a stop and a second stop; and, in said extended position of said shuttle, said stop and said second stop engaging said protrusion and said second protrusion respectively and limiting movement of said shuttle to said incremental distance.

25. The incremental advance dispenser according to claim 22, further including:

said elongated member and said second elongated member being connected to said barrel by a plurality of flexible bridges.

26. The incremental advance dispenser according to claim 22, further including:

said elongated member and said second elongated member connected to said sleeve by an adhesive.

* * * * *